US010309023B2

(12) United States Patent
Prado Pueo

(10) Patent No.: US 10,309,023 B2
(45) Date of Patent: Jun. 4, 2019

(54) ANODE STRUCTURE FOR METAL ELECTROWINNING CELLS

(71) Applicant: INDUSTRIE DE NORA S.P.A., Milan (IT)

(72) Inventor: Felix Prado Pueo, Monzon (ES)

(73) Assignee: INDUSTRIE DE NORA S.P.A., Milan (IT)

( * ) Notice: Subject to any disclaimer, the term of this patent is extended or adjusted under 35 U.S.C. 154(b) by 133 days.

(21) Appl. No.: 15/119,266

(22) PCT Filed: Feb. 3, 2015

(86) PCT No.: PCT/EP2015/052122
§ 371 (c)(1),
(2) Date: Aug. 16, 2016

(87) PCT Pub. No.: WO2015/079072
PCT Pub. Date: Jun. 4, 2015

(65) Prior Publication Data

US 2017/0009359 A1 Jan. 12, 2017

(30) Foreign Application Priority Data

Feb. 19, 2014 (IT) ..... MI2014A0238

(51) Int. Cl.
*C25C 7/06* (2006.01)
*C25C 7/02* (2006.01)
(Continued)

(52) U.S. Cl.
CPC ..... *C25C 7/06* (2013.01); *C25C 1/00* (2013.01); *C25C 1/12* (2013.01); *C25C 7/02* (2013.01)

(58) Field of Classification Search
CPC ..... C25C 7/00; C25C 7/02–7/025; C25C 7/08
See application file for complete search history.

(56) References Cited

U.S. PATENT DOCUMENTS 4,406,769 A * 9/1983 Berger ..... C25C 7/02 204/281
4,661,232 A * 4/1987 Koziol ..... C25C 7/02 204/288.2
(Continued)

FOREIGN PATENT DOCUMENTS

CN 202595298 U 12/2012
EP 0468285 A1 1/1992
(Continued)

OTHER PUBLICATIONS

International Search Report and Written Opinion for International Application No. PCT/EP2015/052122 (dated Jun. 1, 2015) (8 Pages).

*Primary Examiner* — Alexander W Keeling
(74) *Attorney, Agent, or Firm* — Lucas & Mercanti, LLP

(57) ABSTRACT

An anodic structure for electrowinning cells having an anode hanger bar, a support structure of insulating material, at least one anode mesh having a valve metal substrate provided with a catalytic coating, said at least one anode being subdivided into at least two reciprocally insulated sub-meshes, said sub-meshes being individually supplied with electrical current through conductive means connected with said anode hanger bar, the anodic structure being further provided with at least one electronic system having at least one current probe and at least one actuator for individually measuring and controlling current supply to each of said sub-meshes.

14 Claims, 4 Drawing Sheets

(51) Int. Cl.
*C25C 1/12* (2006.01)
*C25C 1/00* (2006.01)

(56) References Cited

U.S. PATENT DOCUMENTS

| | | | | |
|---|---|---|---|---|
| 4,935,108 | A | 6/1990 | Rohlev | |
| 6,153,328 | A | 11/2000 | Colborn | |
| 2011/0240483 | A1* | 10/2011 | Tremblay | C25B 15/02 205/337 |
| 2014/0209455 | A1* | 7/2014 | Prado | C25C 7/00 204/229.8 |
| 2015/0197867 | A1* | 7/2015 | Gieron | C25C 1/12 205/103 |

FOREIGN PATENT DOCUMENTS

| | | | |
|---|---|---|---|
| EP | 0491163 | A1 | 6/1992 |
| WO | 2013060786 | A1 | 5/2013 |

* cited by examiner

ANODE STRUCTURE FOR METAL ELECTROWINNING CELLS

This application is a U.S. national stage of PCT/EP2015/052122 filed on Feb. 3, 2015 which claims the benefit of priority from Italian Patent Application No. MI2014A000238 filed Feb. 19, 2014 the contents of each of which are incorporated herein by reference.

FIELD OF THE INVENTION

The present invention relates to an anode structure suitable for managing a uniform growth of the metal deposit, for preventing short-circuits or reducing anode electrical damage in electrolytic cells used in particular in plants of electrowinning or electrorefining of nonferrous metals.

BACKGROUND OF THE INVENTION

Current supplied to cells of electrochemical plants, with particular reference to metal electrowinning or electrorefining plants, may be apportioned to the individual cell electrodes in a very diverse and inhomogeneous way, negatively affecting the production. This kind of phenomena can take place due to a number of different reasons. For instance, in the particular case of metal electrowinning or electrorefining plants, the negatively polarised electrodes (cathodes) are frequently withdrawn from their seats in order to allow harvesting the product deposited thereon, to be put back in place later on for a subsequent production cycle. This frequent handling, which is generally carried out on a very high number of cathodes, often brings about an imperfect repositioning on the bus-bars and far from perfect electrical contacts, also due to the possible formation of scales on the relevant seats. It is also possible that product deposition takes place in an irregular fashion on the electrode, with formation of product mass gradients altering the profile of cathode surfaces. When this occurs, a condition of electrical disequilibrium is established due to the anode-to-cathode gap which in fact is not constant anymore along the whole surface: the electrical resistance, which is a function of the gap between each anode-cathode pair, becomes variable worsening the problem of unevenness in current distribution. Such phenomenon is often observed, for example, in the case of copper wherein a lesser deposition takes place in the upper part of the cathodes, where a greater amount of gas is present causing an increase in the electrical resistance.

Another problem, particularly common again in the case of copper, is the occasional formation of dendritic deposits, growing locally as faster as the local anode-to-cathode gap decreases, until establishing a short-circuit condition. In the event of a short-circuiting, current tends to concentrate on the short-circuited cathode subtracting current to the remaining cathodes and seriously hampering production, which cannot be restored before the short-circuited cathode is disconnected from the cell.

An uneven distribution of current also generates a loss of quality and production capacity, as mentioned above, challenging the integrity and lifetime of anodes of modern conception manufactured out of titanium meshes.

In industrial plants, given the high number of cells and electrodes present, the tasks of maintaining a uniform deposition, preventing short-circuits or reducing anode damage due to short-circuiting are of high complexity and difficult practical execution.

SUMMARY OF THE INVENTION

The present invention permits to manage a uniform growth of the deposited metal on the cathode surface of electrowinning cells and/or to prevent short-circuiting or damage of the anode that may occur, for example, due to the phenomenon of dendrites, irregular deposition growth or by mechanical accidents that may put anodes and cathodes in direct electric contact.

Furthermore, the present invention allows to maintain the anode in operation in case of the concurrencies above, by selectively discontinuing the current flow only in correspondence of limited portions of the anode, limiting productions losses and optimising the metal deposition process.

Consequently, the present invention fosters an increase in capacity and quality of the production and preserves the anodic structure.

Various aspects of the invention are set out in the accompanying claims.

Under one aspect, the invention relates to an anodic structure for electrowinning cells comprising an anode hanger bar, a support structure made of electric insulating material, at least one anode mesh comprising a valve metal substrate provided with a catalytic coating, said at least one anode mesh being subdivided into at least two reciprocally insulated sub-meshes, said sub-meshes being individually supplied with electrical current through conductive means connected with said anode hanger bar, said anodic structure being further provided with at least one electronic system comprising at least one current probe and at least one actuator for individually measuring and controlling current supply to each individual sub-mesh.

The term "anode mesh" is intended to define an electrode facing a corresponding cathode.

The term "sub-meshes" is intended to define a series of projected geometric surfaces into which the anode mesh is subdivided.

The term "mesh" is used to indicate a foraminous structure.

The anodic structure according to the invention may comprise two anode meshes connected to one same hanger bar and located at opposite sides of the support structure, wherein each anode mesh faces a corresponding cathode and wherein each anode mesh is subdivided into at least two sub-meshes. The anodic structure can further comprise a slim panel sandwiched between two anode meshes. The panel can be constituted of a plurality of smaller sub-panels. The panel can have an overall area comparable to the projected surface area of the anode mesh and be a few millimetres thick; it can be made of a material, such as plastic or resin, resistant to the acid electrolyte and apt to work at the operating temperatures of the cell.

The sub-meshes in which the anode mesh is subdivided can be of equal or different area.

Preferably, the support structure of insulating material as well as all the elements immersed into the electrolyte during the operation of the anodic structure should be resistant to the acid electrolyte environment.

The anodic structure according to the invention can have the advantage of allowing, through its system of current control, the continuous operation of the anode, even in case of dendrites or highly irregular deposition of metal at the cathode, by disconnecting only the sections of the anode mesh that are being affected by current irregularities.

The sub-meshes hereinbefore described can be reciprocally electrically insulated with materials such as plastics or resins. In addition, or in alternative, the sub-meshes can be reciprocally insulated by the presence of a physical gap between them. The physical gap, if any, can be advantageously chosen to be above 3 mm, for example around 8 mm.

The individual measurement of the current supplied to each individual sub-mesh can be performed with a direct measurement or by means of an indirect appraisal of the current flowing into the sub-mesh, such as, for example, assessing local temperature variations or triggering a specific electrical response to current intensity in passive electronic components (for example thermistors or resettable fuses, wherein each can act as both current probe and actuator of the electronic system).

In one embodiment of the anodic structure according to the invention, said at least one anode mesh is subdivided into sub-meshes of area ranging between 25 $cm^2$ and 225 $cm^2$.

The term "area" is intended to define the geometric projected area.

In one embodiment, the conductive means of the anodic structure according to the invention are metal bars, plates or cables. The conductive means can be miniaturised and/or assembled into one or more electronic circuits.

In one embodiment, the metal bars, plates or cables of the anodic structure according to the invention are made of an electrically conductive material with electric resistivity of $1.5\times10^{-8}$ to $3.0\times10^{-8}$ Ω×m, such as copper, aluminium, or alloys thereof. The electric resistivity of the conductive means refers to a measurement performed at 20° C. with a multimeter, using a four wire measurement set-up.

In one embodiment, the anodic structure according to the invention has said sub-meshes in reciprocal electrical insulation secured to said support structure of insulating material by fastening means.

In a further embodiment, the anodic structure according to the invention has said conductive means and said at least one electronic system embedded and sealed inside the support structure by means of materials such as resins or plastics.

In a further embodiment, each sub-mesh of the anodic structure according to the invention is equipped with at least one electronic system that individually controls the current feed of the sub-mesh.

In another embodiment, the electronic system comprises active components, such as transistors, MOSFETS, switches, load switches, operational amplifiers, Micro Controller Units (MCUs), Analog-to-Digital Converters (ADCs) and/or passive electronic components.

The use of active components can have the advantage of allowing active control and provide recording and management capabilities of the current flowing in the sub-meshes.

In order to power these active components, it is possible to take advantage of the electric potential difference between the anodic structure according to the invention and the cathodic intercell bar or balance bar, if any, of the electrolyser. The electronic system, or one or more of its components, may be electrically connected with conductive means, such as a metal cable, extending from the anodic structure and in electrical contact with the cathodic intercell bar or balance bar.

In another embodiment, the electronic system comprises passive components such as thermistors or resettable fuses (such as resettable PPTC fuses, also known as Polymeric Positive Temperature Coefficient fuses, polyfuses or polyswitches). The inventor has found that the use of these passive components can simplify the system set-up. Thermistors and resettable fuses are self-actuated passive devices that provide an indirect measurement of the current flowing through a circuit and offer a simple means to control and cancel over-currents, acting as both the current probe and the actuator of the electronic system. They are characterised by a highly nonlinear response relation between voltage and current and they prevent overcurrent faults by self-triggering the interruption/activation of the current flow in a circuit without the need of external power supplies or third party's interventions. These passive components for current control can be implemented in conjunction with active components that can be used for recording and alert purposes.

Under another aspect, the invention relates to a system for the deposition of metal in an electrochemical metal electrowinning plant comprising at least one anodic structure as hereinbefore described. The system can be also employed in electroplating and electrorefining plants and can be used for short circuit prevention, reduction of anode damage due to dendrite contact and/or for managing the homogeneous deposition of metal. The system further allows to maintain the anode in operation, even in the occurrence of localised current anomalies, by discontinuing only portions of the anodic structure, thanks to the partitioning of the anode mesh into at least two sub-meshes. The inventor has found that by selectively interrupting the power supply to certain sub-meshes through the electronic system it is possible to strongly retard the growth of any dendrites formed on the cathode in the direction perpendicular to the surface of the anode as well as to obtain a uniform deposition of metal on the cathode.

Under another aspect, the invention relates to a system for metal deposition in a metal electrowinning plant, comprising at least one anodic structure as hereinbefore described, wherein each sub-mesh is electrically connected in series with at least one passive electronic system chosen among positive temperature coefficient thermistors or resettable fuses. In order to prevent overcurrent faults, each passive electronic system is selected according to its characteristic current parameters. When the passive system is a positive temperature coefficient resettable fuse, its characteristic current parameters can be advantageously chosen as described hereinafter: 1) a hold current value equal to the maximum nominal current that can be supplied in operation conditions to each individual sub-mesh; 2) a trip current value lower than the maximum safety current for each sub-mesh. It is advisable to choose a passive electronic system in which the drop of voltage is stable and low in value under nominal operating conditions, in order to minimise energy loss and overheating when the passive device operates at currents below the hold current.

The following definitions refer to quantities measured at the operating temperatures of the anodic structure as hereinbefore described, typically 45° C. to 55° C.

The term "trip current" is intended to define the characteristic current threshold of the passive electronic system at the passage of which the electronic system interrupts the current flow. Only small values of stray currents, known as leakage currents, can flow through the passive component in a "tripped" state.

The term "hold current" is intended to define the characteristic current threshold below or equal to which the passive component is guaranteed not to trip the device.

The term "maximum safety current" is intended to define the maximum current that does not jeopardise safety and preservation of the individual sub-meshes and circuits.

The term "nominal current" is intended to define the current that flows in the sub-meshes under ideal operating conditions, i.e. in the absence of relevant criticalities occurring in the production process.

The thermistors or resettable fuses hereinbefore described can be encased in air or foam-filled chambers to thermally insulate them from the environment and ensure their reliability during operation.

The inventor has found that a selective and timely interruption of the power supplied to certain sub-meshes by means of passive electronic systems, such as thermistors or resettable fuses, prevents appreciable short-circuit damages to the sub-mesh in an advantageously simplified fashion, even in case of dendrite contact or misalignment of the anode/cathode contacts, since these passive components do not require external power supplies and their operation is self-regulated.

The systems hereinbefore described can be paired with an alert and/or data recording system. For example, the anode structure may be equipped with a Light Emitting Diode (LED) that may be used to provide a visual warning of a current anomaly occurring in at least one sub-mesh of the anodic structure. In addition, or in alternative, the anodic structure according to the present invention can be equipped with a wireless communication device that sends data concerning the operation of the system to a main central computer.

Under another aspect, the invention relates to a method for the deposition of metal in a metal electrowinning plant wherein for each anode mesh the electronic system detects the current in each sub-mesh at predefined time intervals. The electronic system, after carrying out the measurement, determines for each anode mesh the relative maximum current circulating in its sub-meshes and discontinues the current supply to the sub-mesh, or the sub-meshes, corresponding to the relative maximum detected. In such at least one sub-mesh, the system discontinues the current until the subsequent measurement. This method fosters a uniform growth of the deposited metal on the cathode surface.

Since there exists an electric potential difference between the anodic structure and the discontinued sub-mesh, whose electric potential corresponds to that of the electrolyte, the skilled person can use this energy difference to power, fully or in part, the active components of the electronic system and/or the alert or current recording means.

Under another aspect, the invention relates to a method for the deposition of metal in a metal electrowinning plant wherein for each anode mesh the electronic system detects the current in each sub-mesh at predefined time intervals. The electronic system, after carrying out the measurement, determines for each anode mesh the relative maximum current circulating in its sub-meshes and compares the relative maximum current with a certain predefined value. If the relative maximum current value exceeds said pre-set threshold, the electronic system discontinues the current supply to the sub-mesh, or sub-meshes, corresponding to the relative maximum detected until the next measurement. The preset current threshold can be redefined after each measurement. Its value can be defined by a MCU, based for example on the current values history of the sub-meshes.

In a metal electrowinning or electrorefining plant, the method hereinbefore described can be advantageously employed, for example, for the homogeneous deposition of metal, short circuit prevention or reduction of short circuit damage to the anode.

Under another aspect, the invention relates to a method for metal deposition in a plant for electrochemical metal deposition, wherein for each anode mesh the electronic system measures the current of each sub-mesh at predefined time intervals and discontinues the current supply in those sub-meshes, if any, where the current values exceed a certain pre-set threshold. In such sub-meshes the system discontinues the current until the subsequent measurement. Also in this case, the preset current threshold can be redefined after each measurement and can be different for different sub-meshes. For each anode mesh, it is possible to preset a maximum number of sub-meshes that can be disconnected during operation, in order to avoid any collapse risk of the system. In this case, the sub-meshes to be disconnected can be chosen by prioritising the sub-meshes according to their current value, relative position and previous current history. The method hereinbefore described can be advantageously employed, for example, for short circuit prevention or for reduction of short circuit damage to the anode.

Under another aspect, the invention relates to a method for metal deposition in a metal electrowinning plant, suitable for short circuit prevention or reduction of short circuit damage to the anode, comprising at least one anodic structure as hereinbefore described, wherein for each anode mesh the electronic system detects the current in each sub-mesh at predefined time intervals. For each anode mesh, the electronic system calculates the average current flowing in the sub-meshes in which the anode mesh is sub-divided and calculates their relative deviation from the average. By relative deviation it is meant the difference between the current value of the sub-mesh and the average, divided by the average current value. The system discontinues the current supply to the sub-meshes in which the relative deviation exceeds a predefined value. In such a sub-mesh, the system discontinues the current until the subsequent measurement. Said predefined value can vary between sub-meshes and in time, for instance it can be redefined by a MCU after each measurement, and its value can be based on the current values history and the sub-mesh position.

Some implementations exemplifying the invention will now be described with reference to the attached drawings, which have the sole purpose of illustrating the reciprocal arrangement of the different elements relatively to said particular implementations of the invention; in particular, drawings are not necessarily drawn to scale.

DETAILED DESCRIPTION OF THE DRAWINGS

Figure 1:
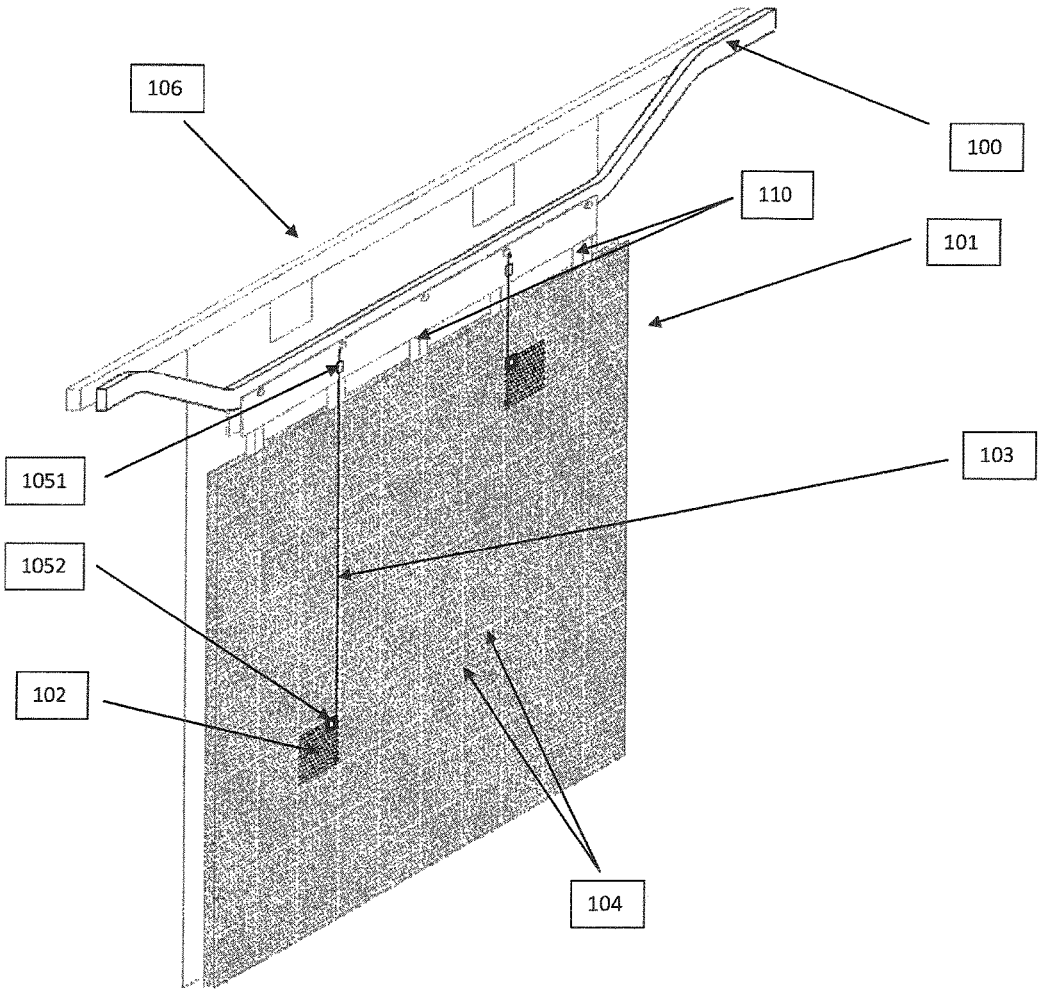
FIG. 1 shows a three dimensional view of the anodic structure according to the invention having both anode meshes subdivided into one hundred sub-meshes.

In FIG. 1 there is shown an anode hanger bar 100, supporting two anode meshes mechanically connected to a support structure of five vertical bars 110. The frontal anode mesh 101, which partially hides the posterior anode mesh (not referenced), is subdivided into 100 sub-meshes, such as sub-mesh 102. Also shown are electrical connection cables 103, the insulation gap 104 between sub-meshes, and cathode 106. The electronic system of current adjustment can be placed in correspondence of location 1051. In addition, or in alternative, the electronic system of current adjustment can be placed directly in correspondence of the sub-mesh to be controlled, such as position 1052 for sub-mesh 102.

Figure 2:
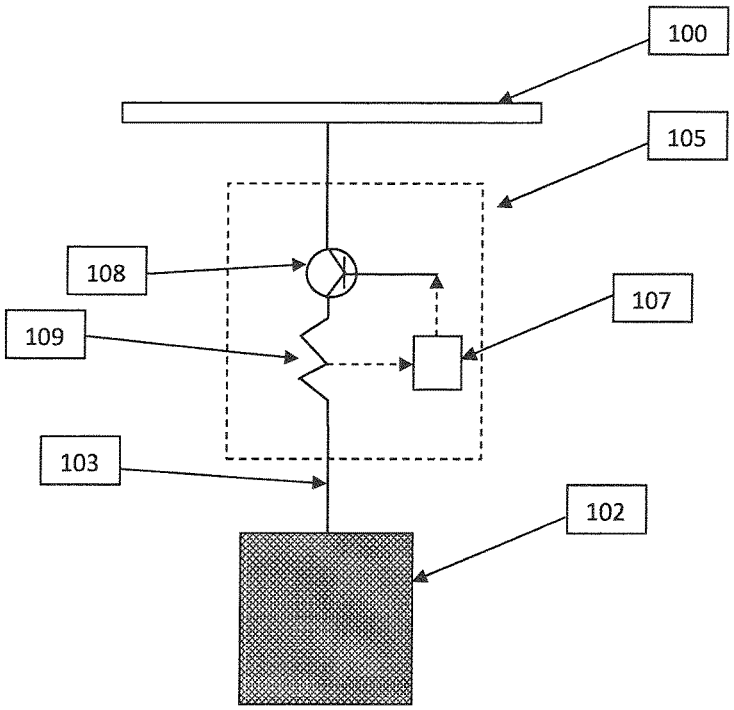
FIG. 2 shows a scheme of sub-mesh to anode hanger bar connection and a possible system of active current adjustment/disconnection associated therewith.

In FIG. 2 there is shown a schematic diagram of an active electric microcircuit indicating the area corresponding to the electronic system circuit 105, connected to sub-mesh 102 via the relevant connection cable 103, on one side, and to the anode hanger bar 100 on the other side. The active electronic system circuit 105 comprises a resistor 109 and a combination of control 107 and active component 108. The latter component may be, for example, a transistor, a MOSFET, a switch transistor or a load switch. Elements 107 and 108 can compare the drop of voltage at the resistor with a predefined reference voltage; when the resistor drop of voltage is bigger than the voltage reference for a preset period of time, element 107 triggers the gate lock of element 108.

Figure 3:
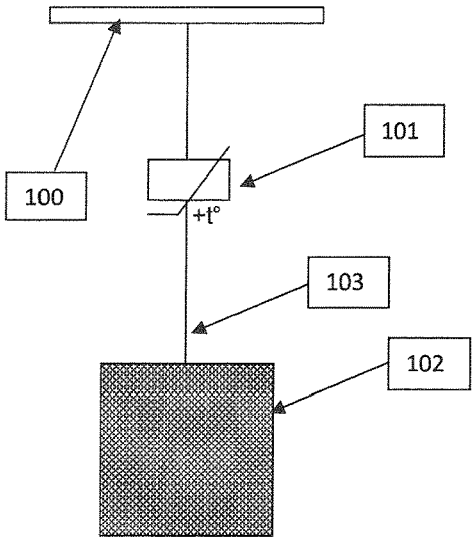
FIG. 3 shows a scheme of the connections of the sub-meshes to the anode hanger bar and a possible system of passive current adjustment/disconnection associated therewith.

In FIG. 3 there is shown a diagram of a passive electric system indicating the area corresponding to the passive electronic device 101, which can be a positive temperature coefficient thermistor or resettable fuse, connected to sub-mesh 102 via the relevant connection cable 103, on one side, and the anode hanger bar 100 on the other.

Figure 4:
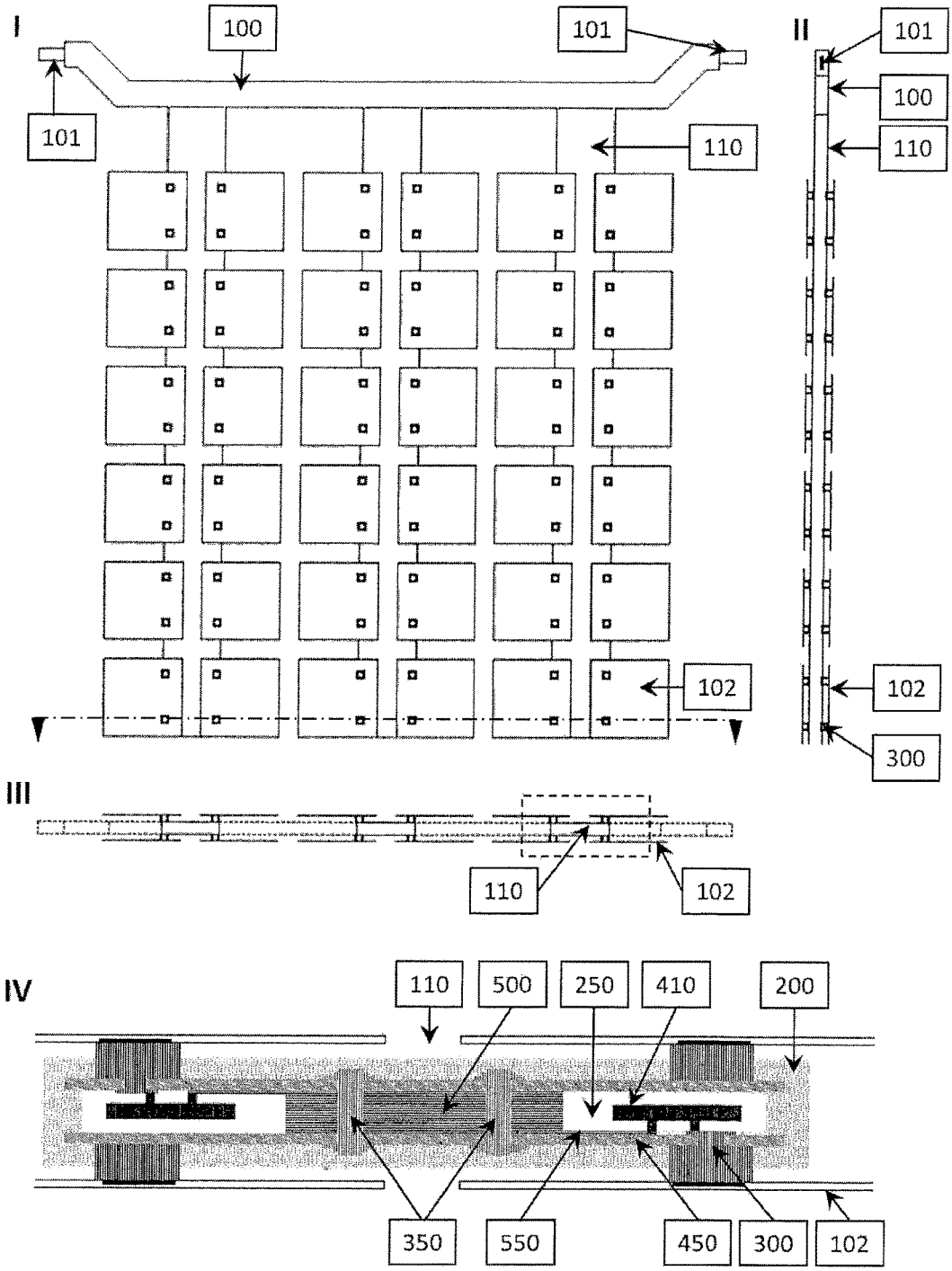
FIG. 4 shows a schematic representation of the anodic structure according to the invention implementing a passive control system with polyfuses, panels (I) and (II) show frontal and side views of the anodic structure; panels (III) and (IV) respectively show the designated cross section of the anodic structure and a blow up of the designated portion of the cross-section.

In FIG. 4, panels I and II show, respectively, a front and side view of an anodic structure implementing passive current probe and control components comprising electrically conductive hanger bar 100 with terminal contacts 101, and two anode meshes each divided into 36 sub-meshes, such as sub-mesh 102. Sub-mesh 102 is connected to the supporting means 110 through conductive and chemically resistant rivets 300, which can be made, for example, of titanium or alloys thereof. Panel III shows the cross section of the anodic structure of Panel I taken along the dash-dotted line. The region enclosed in the dashed area comprising supporting means 110 and sub-mesh 102 is enlarged in panel IV, which shows a blow-up of the connection between sub-mesh 102 and the supporting means 110. The supporting means 110, which are electrically connected to the anode hanger bar (not shown), comprise conductive bar 500, which is fixed to printed circuit board 450 via rivets 350. Conductive bar 500 is connected to one pin of Polyfuse 410 via printed circuit board track 550. The second pin of Polyfuse 410 is in electrical contact with sub-mesh 102 through rivet 300. Polyfuse 410 is enclosed in thermally insulating region 250 (which can be filled, for example, with thermally insulating foam or air). An overlay of electrically insulating and chemical resistant material 200 seals, insulates and protects from the electrolyte the above mentioned components and circuits with the exception of rivet 300, which partially emerges from the supporting means and secures sub-mesh 102 to structure 110.

Figure 5:
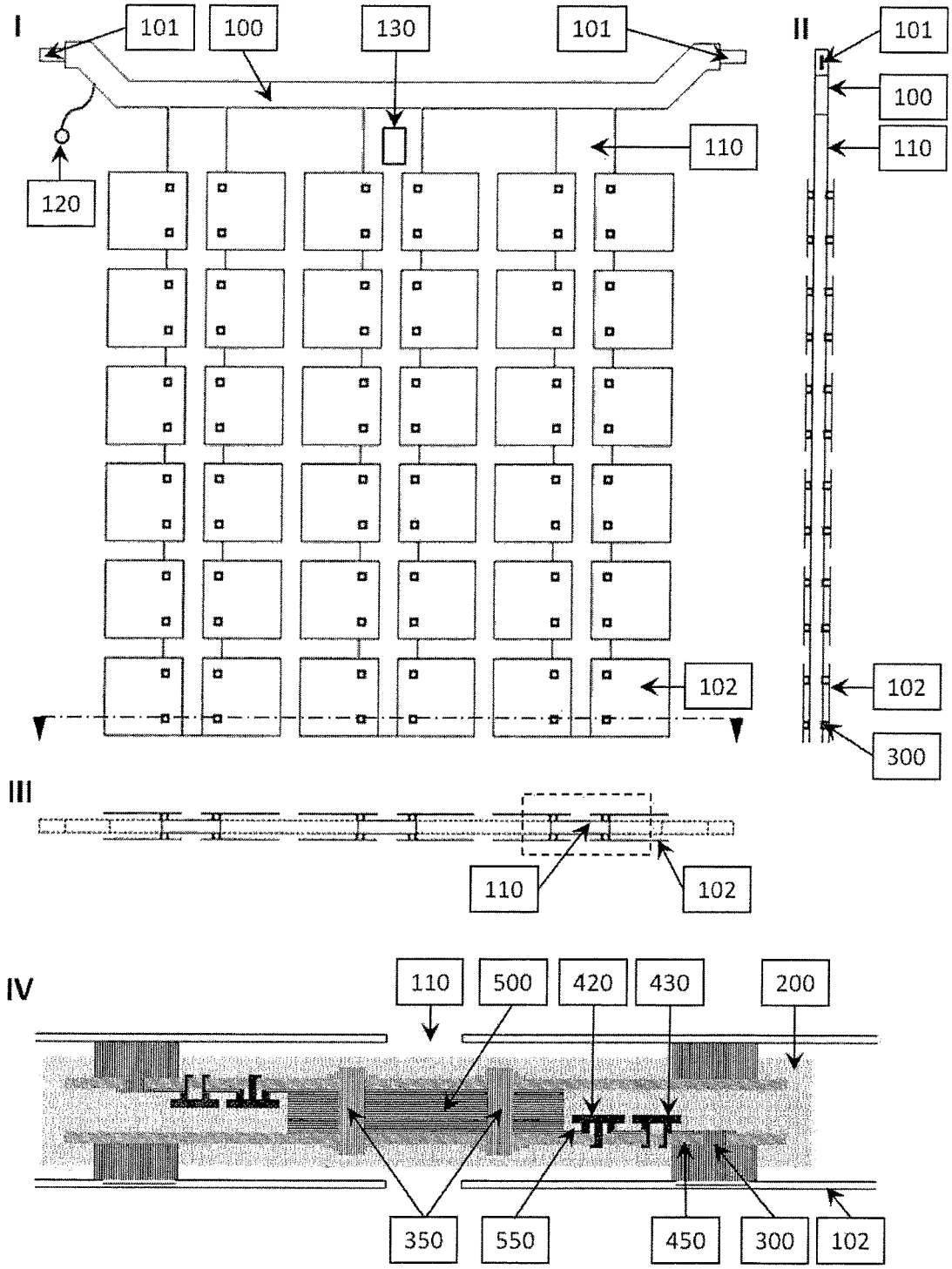
FIG. 5 shows a schematic representation of the anodic structure according to the invention implementing an active control system comprising a MCU and power transistors, panels (I) and (II) show frontal and side views of the anodic structure; panels (III) and (IV) respectively show the designated cross section of the anodic structure and a blow up of the designated portion of the cross-section.

In FIG. 5, panels I and II show, respectively, a front and side view of an anodic structure implementing active current control components comprising electrically conductive hanger bar 100 with terminal contacts 101, and two anode meshes consisting of 6×6 sub-meshes, such as sub-mesh 102. The anodic structure further comprises at least one MCU 130. Cable connection 120 connects the MCU to the cathodic intercell bar or on the cathodic balance bar, if any, on one side, and to the hanger bar 100, on the other side (connections not shown). Sub-mesh 102 is connected to the supporting means 110 through conductive and chemically resistant rivets 300, which can be made, for example, of titanium or alloys thereof. Panel III shows the cross section of the anodic structure of Panel I taken along the dash-dotted line. The region enclosed in the dashed area comprising supporting means 110 and sub-mesh 102 is enlarged in panel IV. Panel IV shows a blow-up of the connection between sub-mesh 102 and the supporting means 110. The supporting means 110, which are electrically connected to the anode hanger bar (not shown), comprise conductive bar 500, which is fixed to printed circuit board 450 via rivets 350. Conductive bar 500 is connected to one terminal of transistor 420 via printed circuit board track 550. Transistor 420 is further connected with shunt resistance 430, which is in electrical contact with sub-mesh 102 via rivet 300. The connection between the shunt resistance 430 and the MCU 130, and the connection between the latter and the gate of transistor 420 are not shown in figure. These connections respectively carry the input and output signals to/from the MCU, which can be equipped with an analog to digital converter (not shown). Transistor 420 and shunt resistance 430 can be connected according to the diagram of FIG. 2 to an additional control transistor (not shown). An overlay of electrically insulating and chemical resistant material 200, such as resin or plastic, seals, insulates and protects from the electrolyte the above mentioned components and circuits with the exception of rivet 300, which partially emerges from the supporting means and secures sub-mesh 102 to structure 110.

Some of the most significant results obtained by the inventor are presented in the following examples, which are not intended to limit the scope of the invention.

EXAMPLE 1

A laboratory test campaign was carried out inside an electrowinning cell, containing a cathode and an anode equipped with an active current control electronic system. A 3 mm thick, 50 mm wide and 1000 mm high AISI 316 stainless steel sheet was used as the cathode; the anode consisted of a 2 mm thick, 150 mm wide and 1000 mm high titanium expanded mesh, activated with a coating of mixed oxides of iridium and tantalum, subdivided into sub-meshes of 1 $dm^2$ each. The cathode and the anode were vertically facing each other with a gap of 40 mm between the outer surfaces. A dendrite was produced artificially by inserting a screw, as a nucleation centre, into the stainless steel plate perpendicularly to the anode, the tip of the screw being spaced 4 mm apart from the anode. Each sub-mesh was electrically connected to the anode hanger bar and to the electronic system according to the diagram of FIG. 2. For each sub-mesh, the electronic system comprised two different MOSFET transistors, one working as the power switch 108, and the other as controller 107. The power switch was characterised by a drain-source breakdown voltage of −30V, and an on resistance of 8 mΩ at a gate threshold voltage of −10V. The controller transistor was characterised by a drain-source breakdown voltage of −30V, and an on resistance of 85 mΩ at a gate threshold voltage of 4.5 V. In place of resistor 109 of FIG. 2, a shunt resistance of 2 mΩ was used. A 32-bit, 67 MHz MCU recorded the current values of each sub-mesh at time intervals of 1 milliseconds, calculating the relative deviation from the average current of each sub-mesh. The MCU was programmed to interrupt the current in the sub-meshes where the relative deviation exceeded 5%. In addition, a wireless ZigBee radio communication system was installed on the anode and sent the information collected by the MCU to a main control computer, for managing and alert purposes. After 4 days of operation a lateral growth of copper was evidenced on the dendrite, not reaching the anode surface. The production of copper in the areas facing the remaining sub-meshes showed no irregularities.

COUNTEREXAMPLE 1

The anodic structure of Example 1 was tested in the same conditions without activating the electronic control system. The dendrite reached the anode surface after 4 hours of operation, irreparably damaging the anode.

EXAMPLE 2

A laboratory test campaign was carried out in a laboratory cell simulating an electrowinning cell, containing a cathode and an anodic structure equipped with a passive current control electronic system. A 3 mm thick, 150 mm wide and 1000 mm high AISI 316 stainless steel sheet was used as cathode; the anode consisted of a 180 mm long copper hanger bar, 20 mm wide and 40 mm high, and of a 1 mm thick, 155 mm wide and 1030 mm high titanium expanded mesh, activated with a coating of mixed oxides of iridium, subdivided into 18 sub-meshes, each 75 mm wide and 110 mm high, with a gap of 8 mm between each couple of sub-meshes. The anodic structure was also equipped with a LED, a ZigBee radio communication device and a booster with an output voltage of 3.3 V. The booster was used to power the LED and ZigBee device, which were installed for alert and operation managing purposes. Each sub-mesh was electrically connected to the anode hanger bar and to the electronic system according to the diagram of FIG. 3. More specifically, the electronic system comprised a positive temperature coefficient polyfuse characterised by a hold and trip current specifications at 23° C. of 14.0 A and 23.8 A respectively (a temperature dependent characterization of these parameters was carried out by the inventor in order to assess and verify the polyfuse performance at the operating temperatures of the cell. The hold current at 40° C. was 12.2 A and the trip current was 25.4 A). Each sub-mesh was further connected to a diode. The total of 18 diodes were connected to form a diode-OR circuit that supplied power to the booster and only activated the LED in case of electrical contact between one or more sub-meshes and the cathode.

The cathode and the anode were vertically facing each other with a gap of 35 mm between the outer surfaces. A dendrite was produced artificially by inserting a screw, as a nucleation centre, into the cathodic stainless steel plate perpendicularly to the anode mesh; the tip of the screw being spaced 4 mm apart from the anode. After 1 day of operation in potentiostatic conditions, with a cell voltage of 1.8V, the copper deposited on the tip of the screw would contact the facing anode submesh, resulting in a copper deposition on the specific submesh, the lighting up of the LED and a warning signal from the ZigBee communication device to a main central computer. The test was continued for 60 hours and during such transient the copper would grow along the edges of the submesh panel. At the end of the test, no mechanical damage due to shorting was present on the anode mesh; the current would be in the range of 55-65 A. Eventually, the production of copper in the areas facing the remaining sub-meshes showed no irregularities.

COUNTEREXAMPLE 2

An anodic structure similar to that of Example 2 was tested in the same conditions without providing it with the electronic control system. The dendrite reached the anode surface after 1 day of operation, irreparably damaging the anode mesh.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The invention claimed is:

1. An anodic structure for electrowinning cells comprising:

an anode hanger bar, a support structure of insulating material, at least one anode mesh having a valve metal substrate provided with a catalytic coating, said at least one anode mesh being subdivided into at least two reciprocally insulated sub-meshes, said sub-meshes being individually supplied with electrical current through conductive means connected with said anode hanger bar, the anodic structure being further provided with at least one electronic system, said at least one electronic system individually measuring and controlling current supply to each of said at least two reciprocally insulated sub-meshes, wherein said conductive means and said at least one electronic system are embedded and sealed inside said support structure of insulating material by means of resins or plastics, wherein said at least two reciprocally insulated sub-meshes are secured to said support structure of insulating material by fastening means, wherein each at least two reciprocally insulated sub-meshes is equipped with said at least one electronic system.

2. The anodic structure according to claim 1 wherein said at least one anode mesh is subdivided into said at least two reciprocally insulated sub-meshes of area ranging from 25 $cm^2$ to 225 $cm^2$.

3. The anodic structure according to claim 1, wherein said conductive means are metal plates, bars or cables.

4. The anodic structure according to claim 3, wherein said metal bars, plates or cables are made of electrically conductive material with electric resistivity at 20° C. of $1.5\times10^{-8}$ to $3.0\times10^{-8}$ $\Omega\times m$.

5. The anodic structure according to claim 4, wherein said electrically conductive material is chosen among copper, aluminium or alloys thereof.

6. The anodic structure according to claim 1, wherein said at least one electronic system comprises active or passive electronic components.

7. The anodic structure according to claim 6, wherein said passive electronic components are thermistors or resettable fuses.

8. The anodic structure according to claim 6, wherein the active electronic components of the at least one electronic system are at least one current probe and at least one actuator.

9. System for deposition of metal in a metal electrowinning plant comprising at least one anodic structure according to claim 1.

10. System for metal deposition in a metal electrowinning plant comprising at least one anodic structure according to claim 7, wherein each at least two reciprocally insulated sub-meshes is equipped with at least one resettable fuse, and wherein each said resettable fuse comprises:

a positive temperature coefficient;

a hold current value equal to a predefined current value, wherein said predefined current value corresponds to a maximum nominal current that is supplied to each individual sub-mesh; and a trip current value lower than a maximum safety current for each sub-mesh.

11. Method for deposition of metal in a metal electrowinning plant comprising at least one anodic structure according to claim 1, comprising:

detecting the current in each at least two reciprocally insulated sub-meshes of each at least one anode mesh at predefined time intervals by means of said at least one electronic system and determining a relative maximum current;

identifying the at least two reciprocally insulated sub-meshes of each at least one anode mesh that has the relative maximum current; and discontinuing current supply to said at least two reciprocally insulated sub-meshes which have been identified to have the relative maximum current.

12. Method for deposition of metal in a metal electrowinning plant comprising at least one anodic structure according to claim 1, comprising:

detecting the current in each at least two reciprocally insulated sub-mesh of each at least one anode mesh at predefined time intervals by means of the electronic system;

determining the at least two reciprocally insulated sub-meshes of each at least one anode mesh corresponding to a relative maximum of current; and discontinuing current supply to said at least two reciprocally insulated sub-meshes corresponding to a relative maximum of current if the detected current exceeds a predefined threshold until the subsequent detection.

13. Method for deposition of metal in a metal electrowinning plant comprising at least one anodic structure according to claim 1, comprising:

detecting the current in each at least two reciprocally insulated sub-mesh of each at least one anode mesh at predefined time intervals by means of the electronic system; and discontinuing current supply to the at least two reciprocally insulated sub-meshes in which the current exceeds a predefined threshold until the subsequent detection.

14. Method for deposition of metal in a metal electrowinning plant comprising at least one anodic structure according to claim 1, comprising:

detecting the current in each at least two reciprocally insulated sub-mesh of each at least one anode mesh at predefined time intervals by means of the electronic system;

calculating for each at least one anode mesh the average current value in the at least two reciprocally insulated sub-meshes; and discontinuing the current supply to the at least two reciprocally insulated sub-meshes in which the difference between the detected current and the average current, expressed in percentage of the average current of each at least one anode mesh, exceeds a predefined threshold until the subsequent detection.

* * * * *